United States Patent [19]

Jarrott et al.

[11] Patent Number: 4,632,031

[45] Date of Patent: Dec. 30, 1986

[54] PROGRAMMABLE ELECTRONIC DELAY FUSE

[75] Inventors: Kenneth N. Jarrott, Royston Park; Eric J. Parker, Vista, both of Australia

[73] Assignee: The Commonwealth of Australia, Canberra, Australia

[21] Appl. No.: 689,057

[22] Filed: Dec. 11, 1984

[51] Int. Cl.[4] ..... F42C 11/06

[52] U.S. Cl. ..... 102/200; 102/206

[58] Field of Search ..... 102/200, 206, 215; 361/248

[56] References Cited

U.S. PATENT DOCUMENTS

| | | | |
|---|---|---|---|
| 3,228,337 | 1/1966 | Grantham et al. | 102/207 |
| 3,686,633 | 8/1972 | Carmody | 340/168 CC |
| 3,703,145 | 11/1972 | Burkhardt et al. | 102/270 |
| 4,083,308 | 4/1978 | Levis | 102/215 |
| 4,091,734 | 5/1978 | Redmond et al. | 102/215 |
| 4,144,815 | 3/1979 | Cumming et al. | 102/214 |
| 4,409,897 | 10/1983 | Kirby et al. | 102/200 |
| 4,414,901 | 11/1983 | Sellwood | 102/206 |

FOREIGN PATENT DOCUMENTS

| | | | |
|---|---|---|---|
| 82445 | 12/1982 | European Pat. Off. . | |
| 2138576 | 10/1984 | United Kingdom | 102/206 |

*Primary Examiner*—Charles T. Jordan

*Attorney, Agent, or Firm*—Cushman, Darby & Cushman

[57] ABSTRACT

A programmable electronic delay fuse for initiating a firing after a programmed and accurate delay time has been chosen, comprising a fire control unit (FCU), a programming unit (PU) to program and test the fire control unit (FCU), and optical coupling interface means (1) on each unit to electrically interconnect firing and status means (3) on the fire control unit (FCU) with command and test means on the programming unit.

10 Claims, 3 Drawing Figures

FIRE CIRCUITRY (FC)

PROGRAMMABLE ELECTRONIC DELAY FUSE

INTRODUCTION

Figure 1:
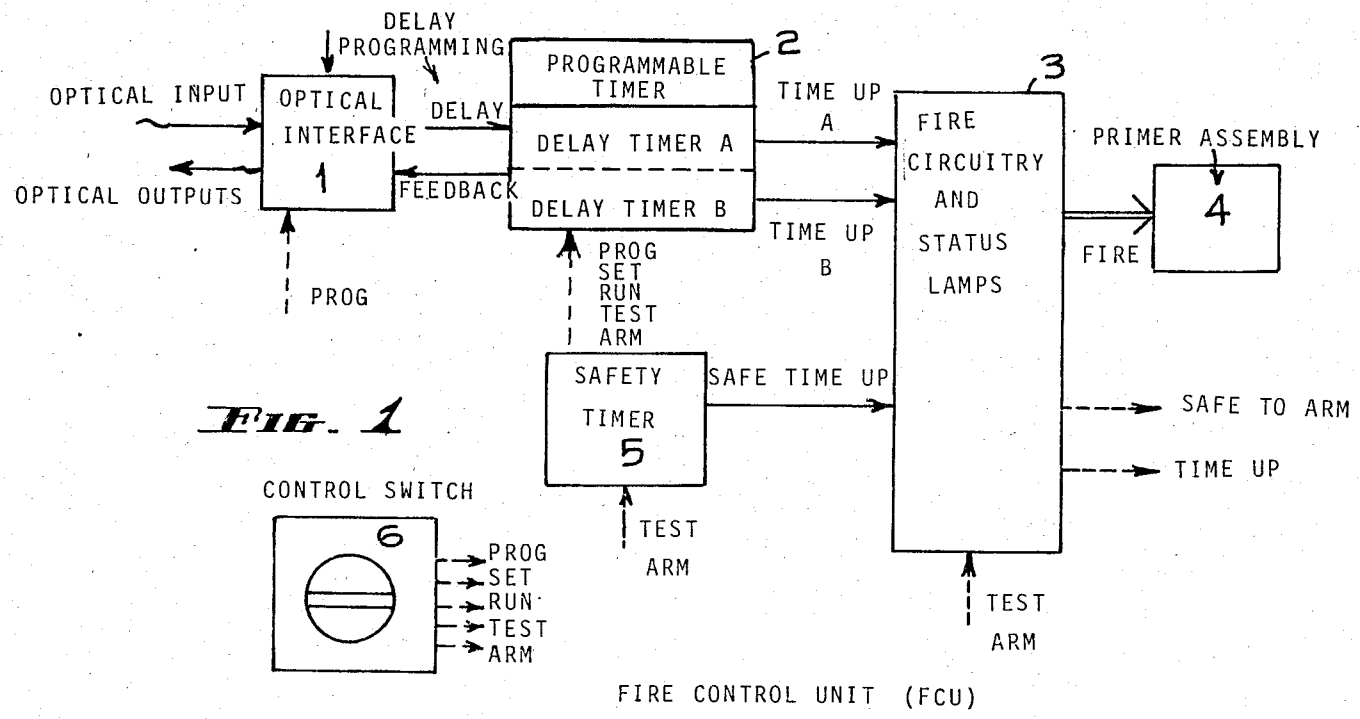

This invention relates to a programmable electronic delay fuse.

The purpose of such a fuse is to provide a device which is capable of initiating a detonator or safety fuse after a preprogrammed and accurate delay time has been chosen.

It is already known to use links between projectiles and missiles, as shown for instance in U.S. Pat. No. 4,091,734, assigned to the United States of America as represented by the Secretary of the Navy, which uses an infrared digital beam to feed data to a missile, and U.S. Pat. No. 3,228,337, also assigned to the United States of America, which uses a laser communication system; and European Patent No. 0 082 445 of Brown, Boveri & Cie Aktiengesellschaft, which relates to a remote programming device for a projectile using a microwave signal which provides a energising signal and a return function-and-correct signal.

The unit comprises basically a fire control unit and a programming unit which are interconnected by an optical interface, the fire control unit having as its purpose the actuation of a non-electric (percussive) or an electric detonator, the purpose of the programming unit being to set the necessary time delays required in a unit of this type.

The device according to this invention can be arranged in many forms; a high reliability, single-fire device with a non-electric (percussive) output, fitted with a non replaceable pyrotechnic actuator; a reusable percussive output device suitable for training, in which the consumed actuator assembled is plug-fitted for easy replacement; or an electrical output device which is inherently a multi-fire device and which may be used for training or operational environments suited to the external connection of the electrical detonator.

According to this invention the fire control unit contains two independent delay timers and a safety timer. The timers supply initiating signals via a fire control circuit to the pyrotechnic actuator for the non-electric version or direct to the output terminals for the electric detonator version.

Operator control and observation of device function in a non-destructive test firing cycle are provided for the fire control unit.

The test firing cycle along with other checks inherent in the programmer unit-fire control unit interaction, may be used to establish the high degree of confidence in device safety and operability required of a product of this kind. Safety is also enhanced by the reversibility by delay programming, time counting and arming processes.

THE INVENTION

The invention consists of a programmable electronic delay fuse for initiating a firing after a programmed and accurate delay time has been chosen, characterised by a fire control unit with means to actuate firing means such as a non-electric (percussive) or an electric detonator, a programming unit separate therefrom having means to program and test the fire control unit, and optical coupling interface means on the fire control unit and the programming unit to link firing and status means on the fire control unit with command and test means on the programming unit.

According to one form the invention consists of a programmable electronic delay fuse for initiating a detonator or safety fuse after a programmed and accurate delay time has been chosen, and comprises a fire control unit and a programming unit interconnected by an optical interface, the fire control unit being arranged to actuate firing means such as a non-electric or an electric detonator and includes time delay means to allow testing and setting of the fire control unit, and multiposition switch means to select delay programming, test and arm activity and includes status indicators for "SAFE TO ARM" and "TIME UP", the programming unit comprising means such as a keyboard for entering instructions and includes a control processor and display, and a power source, the optical coupling interface means between the fire control unit and the programming unit allowing a single programming unit to be used to test and set a series of fire control units. If the actuator fuse is not continuous or if both TIME UP switches 18 and 19 are closed, the safe to arm indicator lamp 12 can not be energized.

DRAWINGS

Figure 2:
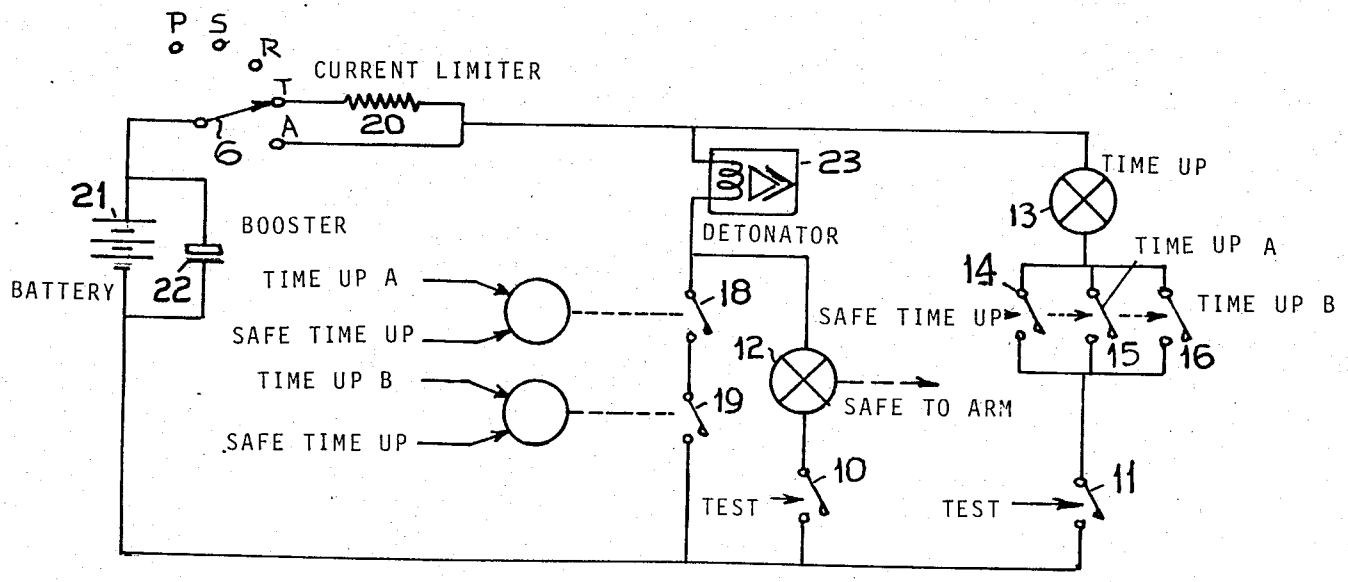
Figure 3:
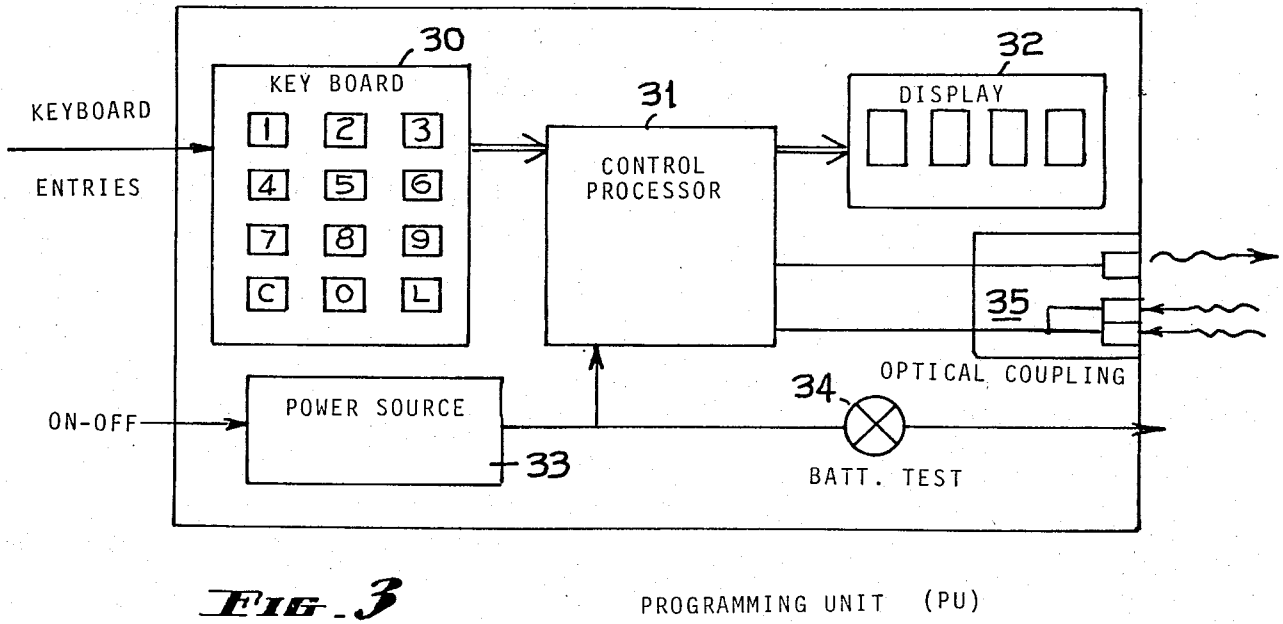

To enable the invention to be fully appreciated but without in any way limiting the invention to the circuitry shown, a preferred form of the invention will be described with reference to the accompanying drawings in which FIG. 1 shows a functional breakdown diagram of the fire control unit, FIG. 2 shows a simplified representation of the fire circuitry, and FIG. 3 is a block diagram of the programming unit.

DESCRIPTION OF FIRE CONTROL UNIT

Referring first to FIGS. 1 and 2 which show the fire control unit FCU, the numeral 1 indicates the interface, the numeral 2 the programmable timer which contains the first delay timer A and the second delay timer B, the numeral 3 shows the fire circuitry which also includes the status lamps, and the numeral 4 represents the primer assembly. The safety timer is designated by 5, and the control switch and power source by 6.

The safety timer 2 has a fixed delay time such as, for instance, forty seconds and provides protection against premature firing of a detonator due to either a single operator or single equipment failure. It inhibits the closure of the fire circuit switches for such time after arming, even if the programmable timer delays have expired.

The two programmable delay timers A and B of the fire control unit are independent delay timers each programmable in delay increments of say one minute over a range of one minute to twentyfour hours, but other time increments and length can be used.

The duplication of delay timers A and B provides a protection against a single fault condition producing a premature detonation in the period after the expiry of the safety delay, and both programmable timers, as well as the safety timer, produce a TIME UP condition for detonation to occur.

In addition to timing the programme delay, both delay timers A and B output a delay-related clock signal to the programming unit via the optical interface 1. These return signals allow the programming unit to verify correct delay programming, and the proper func- The Control Processor 31 interprets the keyboard entries and controls the display function. It also provides a time delay signal to the optical coupling for transmission to the fire control unit, and then receives back from the fire control unit, via the optical coupling a time delay feedback signal, to verify that the correct delay time has been programmed into the fire control unit. The control processor also contains several test procedures which can be used for self testing the programming unit's circuitry including the optical coupling.

The Display 32 can be a four character alpha numeric display which is controlled by the control processor. It is used to display keyboard entries, operational and error messages and also to display the verified delay time of the fire control unit.

The optical Coupling 35 provides one part of the optical link between the programming unit and the fire control unit. It is used to transmit delay times to the fire control unit and to receive back programmed delay times from the two delay timers in the fire control unit.

The programming unit is a reusable hand-held device for programming the fire control unit with delay times. It serves also to act as a testing medium for the fire control unit to ensure a correct response to the programming action.

The keyboard 30 is preferably a twelve key keyboard which allows entry of time digits 0–9 with the remaining two keys used for special operator commands such as clearing the display, test sequencing, and loading the programme time into the fire control unit.

The control processor 31 can be a single chip microprocessor which responds to operator data and controls input via the keyboard, controls message and data readouts on the display 32, and establishes the timing of programming signals to the fire control unit. It also measures the response of the fire control unit to the programming signals to verify the success of the programming action.

The display 32, which can be a four character alpha numeric display, provides visual feed-back of keyboard entries, message prompts for operational and test purposes, and a read-out of the fire control unit programmed time subsequent to programming.

The power source 33 may be supplied by any suitable battery such as an alkaline battery. A regulator circuit is used to ensure that the supply of voltages for the logic devices are held at proper level.

To programme a fire control unit with a delay time the programming unit and the fire control unit are first physically coupled to achieve an alignment of their optical interfaces. This maybe done by sliding the firing control unit into a guide channel incorporated in the body of the programming unit.

After the fire control unit is coupled to the programming unit the programming unit ON/OFF switch is turned to the ON position and the control switch is set on the fire control unit to PROGRAM. The device is now ready for delay time entry. Delay time is entered via the keyboard in hours and minutes with the tens of hours digits being entered first followed by hours, tens of minutes, then minutes. The delay time entered is displayed on the programmer display for confirmation of corrections.

Once satisfied that the correct time delay has been entered, the delay time may be loaded to the fire control unit by pressing a selected key such as by pressing the LOAD key twice, whereby on the first press the control processor checks for valid delay times.

If the programme time is valid a message on the display will prompt the second LOAD key action. If this occurs the time delay will be loaded into the fire control unit and a display blinking sequence will take place until time feed back signals are available from the fire control unit. If incorrect action occurs the loading will not take place.

On completion of the blinking sequence the control processor within the programming unit measures the feed-back signals from both intermediate delay channels from the fire control unit to verify the correct delay loading. The checking time is dependent upon the length of the programme delay and may be as long as eight seconds for the twentyfour hour delay time. Both delay channels are checked, and displayed messages confirm the checking process. The first message indicates that delay timer A is being measured, the second indicating that the delay timer B is being measured. When both channels are measured they are compared and the measured delay times, if identical, will be displayed, otherwise an error message is displayed.

The sequence can be varied substantially within the spirit of the invention.

The Power Source 33 supplies regulated 5 V power to the internal circuits of the programming unit from a 9 V battery source.

The Battery Test 34, when activated, tests the battery condition by applying a known battery load. A green indicator lamp will not dim during the test if a good battery is present.

From the foregoing it will be realised that the unit comprises firstly a fire control unit which is set to carry out the required action and is provided with the required safety mechanisms and delays, and secondly a programming unit which programs the fire control unit through an interface requiring no permanent connection to the fire control unit so that such a programming unit can be used to test and arm a number of fire control units.

What is claimed is:

1. A programmable electronic delay fuse for initiating a firing after a programmed and accurate delay time has been chosen, characterised by:

(a) a fire control unit (FCU) with means to actuate firing means such as a pyrotechnic actuator or an electric detonator, (b) a programming unit (PU) separate therefrom having means to program and test the said fire control unit (FCU), and (c) optical coupling interface means on the said fire control unit (FU) and the said programming unit (PU) coupled to firing and status means on the said fire control unit (FCU) with command and test means on the said programming unit.

2. A programmable electronic delay fuse according to claim 1 wherein the said fire control unit (FCU) includes a control switch (6) to select programming, set, run, test, and arm circuitry and includes a programmable timer (2) with two programmable delay timers (A,B) arranged to return signals to the said programming unit (PU) to verify correct delay programming in the said fire control unit (FCU).

3. A programmable electronic delay fuse according to claim 1 wherein the test means comprise voltage control means (20) in a fire circuit (FC) to limit current to actuate indicator means but to not enable the firing sequence.

4. A programmable electronic delay fuse according to claim 1 wherein the said programming unit (PU) comprises a control processor (31), a keyboard (30) connected thereto to load said processor (31), display means (32) for the said processor (31), an output channel from the said processor through the said interface (35) to the said programmable timer (PU) to load the said first (A) and the said second (B) delay timers, a pair of channels from the said interface (35) to the said control processor (31) to transmit the said feed-back signals from the said first (A) and the said second (B) delay timers to the said control processor (31), and means in the said control processor (31) to compare the said feed-back signals to verify correct loading of the said delay timers (A, B).

5. A programmable electronic delay fuse according to claim 1 wherein the circuitry of the multiposition switch (6)

(a) allows a programme to be entered (PROG),
(b) allows the timers to be reset to their delay time (SET),
(c) allows the timers to run (RUN),
(d) allows the timers, safety time, fire circuitry and status lamps to be checked (TEST), and
(e) allows the fire control to be set for activation (ARM), or to be deactivated by switching out of the ARM position, the said multiposition switch (6) being connected to enable the fire circuitry (FC) only in the TEST and ARM modes to provide a fire signal only when a time up A and a time up B and a safe time up signal of the fire circuitry are true, and wherein in the TEST mode status lamps are enabled but the fire circuit current is limited below that required for firing, a "SAFE TO ARM" signal is activated when the circuit is complete but fire condition is not true, and a TIME UP signal is activated when either the said time up A or the said time up B or the said safe time up signal is actuated.

6. A programmable electronic delay fuse as in claim 2 wherein the test means comprise voltage control means (20) in a fire circuit (FC) to limit current to actuate indicator means but to not enable the firing sequence.

7. A programmable electronic delay fuse for initiating a firing after a programmed and accurate delay time has been chosen, comprising as separate units a fire control unit (FCU) and a programming unit (PU) therefor, the said fire control unit (FU) being arranged to actuate firing means, the said programming unit (PU) being arranged to set time delays (A B) and to assist testing of the fire control unit (FCU), the said fire control unit (FCU) comprising a safety timer (5), multiposition switch means (6) to select delay programming, a programmable timer (2) to effect test and arm activity and including status indicators for "SAFE TO ARM" and "TIME UP", the said programming unit (PU) comprising means such as a keyboard (30) for entering instructions on the said programming unit (PU), a power source (33), and a control processor (31) and display (32), and the said fire control unit (FCU) and the said programming unit (PU) having coupling interface means (1,35) between them whereby a single programming unit (PU) can be reused to test and set a series of fire control units (FCU).

8. A programmable electronic delay fuse according to claim 7 further characterised in that the interface means (1,35) are optical, and the fire control unit (FU) is arranged to receive control signals from the said control processor (31) including delay time, and the said processor (31) is adapted to measure feed-back signals from the fire control unit (FCU) to verify correct delay loading.

9. A programmable electronic delay fuse according to claim 7 wherein the said programmable timer (2) of the said fire control unit (FCU) includes a first delay timer (A) and a second delay timer (B), means (30) to load programming from the said control processor (31) of the said programming unit (PU) through the said interface means (1,35) to the said delay timers (A,B) and means within the said programming unit to measure via the said interface means (35) the feed-back signals from both said delay timers (A,B) to verify correct loading.

10. A programmable electronic delay fuse according to claim 9 wherein the said programming unit (PU) includes a keyboard (30) to enter data into the said control processor (31), and a display unit (32) coupled to the said control processor (CP).

* * * * *